US010409206B2

(12) United States Patent
Kume et al.

(10) Patent No.: US 10,409,206 B2
(45) Date of Patent: Sep. 10, 2019

(54) FIXING DEVICE HAVING A POSITIONING PORTION THAT IS INSERTED INTO AN OPENING OF A SUPPORTING MEMBER TO PREVENT MOVEMENT OF A HEAT CONDUCTIVE MEMBER

(71) Applicant: CANON KABUSHIKI KAISHA, Tokyo (JP)

(72) Inventors: Takao Kume, Yokohama (JP); Masahito Omata, Yokohama (JP); Yasuhito Minamishima, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/992,800

(22) Filed: May 30, 2018

(65) Prior Publication Data

US 2018/0348676 A1 Dec. 6, 2018

(30) Foreign Application Priority Data

May 31, 2017 (JP) ..... 2017-107780

(51) Int. Cl.
*G03G 15/20* (2006.01)

(52) U.S. Cl.
CPC ..... *G03G 15/205* (2013.01); *G03G 15/206* (2013.01); *G03G 2215/2009* (2013.01)

(58) Field of Classification Search
CPC ..... G03G 15/2039; G03G 15/205; G03G 15/2053; G03G 15/206; G03G 2225/2009
See application file for complete search history.

(56) References Cited

U.S. PATENT DOCUMENTS

| | | | | |
|---|---|---|---|---|
| 7,203,438 | B2 | 4/2007 | Omata et al. | |
| 9,229,388 | B2 | 1/2016 | Imaizumi et al. | |
| 9,417,576 | B2 | 8/2016 | Minamishima et al. | |
| 9,507,303 | B2 | 11/2016 | Imaizumi et al. | |
| 9,720,362 | B2 | 8/2017 | Minamishima et al. | |
| 9,798,280 | B2 | 10/2017 | Omata | |
| 9,829,839 | B2 | 11/2017 | Ando et al. | |
| 9,983,522 | B2 | 5/2018 | Imaizumi et al. | |
| 2006/0157464 | A1 | 7/2006 | Omata et al. | |
| 2016/0139546 | A1 | 5/2016 | Imaizumi et al. | |
| 2016/0139551 | A1* | 5/2016 | Narahara | G03G 15/55 399/33 |
| 2018/0081305 | A1 | 3/2018 | Ando et al. | |

FOREIGN PATENT DOCUMENTS

JP H11-260533 A 9/1999

* cited by examiner

*Primary Examiner* — Hoang X Ngo
(74) *Attorney, Agent, or Firm* — Venable LLP

(57) ABSTRACT

A fixing device includes a heat generating member, an endless belt, and a heat conductive member that contacts the heat generating member in a first region. A positioning portion is provided at an end portion of the heat conductive member, so as to extend in a direction in which the positioning portion is spaced apart from the heat generating member. A supporting member is provided with a first opening at a position corresponding to a second region of the heat generating member, and supports the heat generating member via the heat conductive member. An electrical power shut-off member, located in the first opening of the supporting member, shuts off electrical power supplied to the heat generating member. The positioning portion is inserted into the first opening of the supporting member to prevent movement of the heat conductive member.

11 Claims, 11 Drawing Sheets

(a)

(b)

(a)

(b)

(a)

(b)

FIXING DEVICE HAVING A POSITIONING PORTION THAT IS INSERTED INTO AN OPENING OF A SUPPORTING MEMBER TO PREVENT MOVEMENT OF A HEAT CONDUCTIVE MEMBER

This application claims the benefit of Japanese Patent Application No. 2017-107780, filed May 31, 2017, which is hereby incorporated by reference herein in its entirety.

FIELD OF THE INVENTION AND RELATED ART

The present invention relates to a fixing device for use with an image forming apparatus, such as a copying machine or a laser beam printer, employing an image forming process of an electrophotographic type, an electrostatic recording type, or the like.

As a type of the fixing device, a film fixing type using a ceramic heater has been known. Further, conventionally, a countermeasure against "offset of end portion position due to non-sheet-passing-portion temperature rise" has been considered. That is, when a small sized-paper (recording material) is passed through the fixing device, in an end portion region in which the recording material is not passed through the fixing device, an amount of heat from a heat generating member is accumulated as it is, and the end portion region is very high in temperature in some cases. In such a state, in a case in which a plain paper-sized (large-sized) recording material is passed through the fixing device, such a hot-offset phenomenon occurs in which toner is excessively melted in the end portion region and thus deposits on a fixing film surface, and then adheres to the fixing film surface when the fixing film is rotated through one-full circumference, generates in some instances.

Therefore, in order to reduce a degree of generation of this phenomenon, a constitution in which, between a heat generating member and a holding member for holding the heat generating member, a member having a greater thermal conductivity than a base material of the heat generating member is provided on an entire region of a back surface of the heat generating member has been known (Japanese Laid-Open Patent Application Hei-11-260533). By this constitution, an amount of heat generating at an end portion position is distributed, and a temperature of the heat generating member in the end portion position is decreased, so that a degree of non-sheet-passing-portion temperature rise is alleviated and thus generation of the hot-offset phenomenon can be prevented.

In this constitution, however, as a heat conductive member, a member formed of metal, such as an aluminum plate, is used, and the heat conductive member expands and contracts by heating, and, therefore, there is a need that the heat conductive member is positioned relative to a supporting member for supporting a heater as the heat generating member. For that purpose, when the holding member is provided with a positioning hole separately from a placement window for an electrical power shut-off member, strength of the supporting member weakens from the positioning hole that is a starting point, so that deformation due to a sag of the supporting member generates in the neighborhood of the positioning hole in some cases.

SUMMARY OF THE INVENTION

A principal object of the present invention is to provide a fixing device capable of suppressing deformation of a supporting member, for supporting a heat generating member, in order to position a heat conductive member.

According to one aspect, the present invention provides a fixing device comprising an elongated heat generating member extending in a longitudinal direction and having a first region and a second region different in the longitudinal direction, an endless belt rotatable in contact with the heat generating member, an opposing member opposing the endless belt and configured to form a nip in cooperation with the endless belt so that a recording material, on which a toner image is formed, is nipped and fed in the nip, a heat conductive member extending in the longitudinal direction within the first region in which a surface of the heat conductive member contacts the heat generating member, a positioning portion extending from an end portion of the surface of the heat conductive member with respect to the longitudinal direction, in a direction in which the positioning portion is spaced from the heat generating member, an electrical power shut-off member provided at a position corresponding to the second region of the heat generating member and configured to shut-off electrical power supplied to the heat generating member, and a supporting member provided with an opening at a position corresponding to the second region and configured to support the heat generating member through the heat conductive member, wherein the opening is configured to permit insertion of the positioning portion to prevent movement of the heat conductive member.

Further features of the present invention will become apparent from the following description of exemplary embodiments with reference to the attached drawings.

DESCRIPTION OF EMBODIMENTS

Embodiments of the present invention will be described with reference to the drawings.

Embodiment 1

Fixing Device

In the following description, a longitudinal direction refers to a direction (first direction) perpendicular to a recording material conveyance direction in a recording material conveying path. A short side direction is the same direction as the recording material feeding direction (second direction crossing perpendicular to the first direction).

Figure 1:
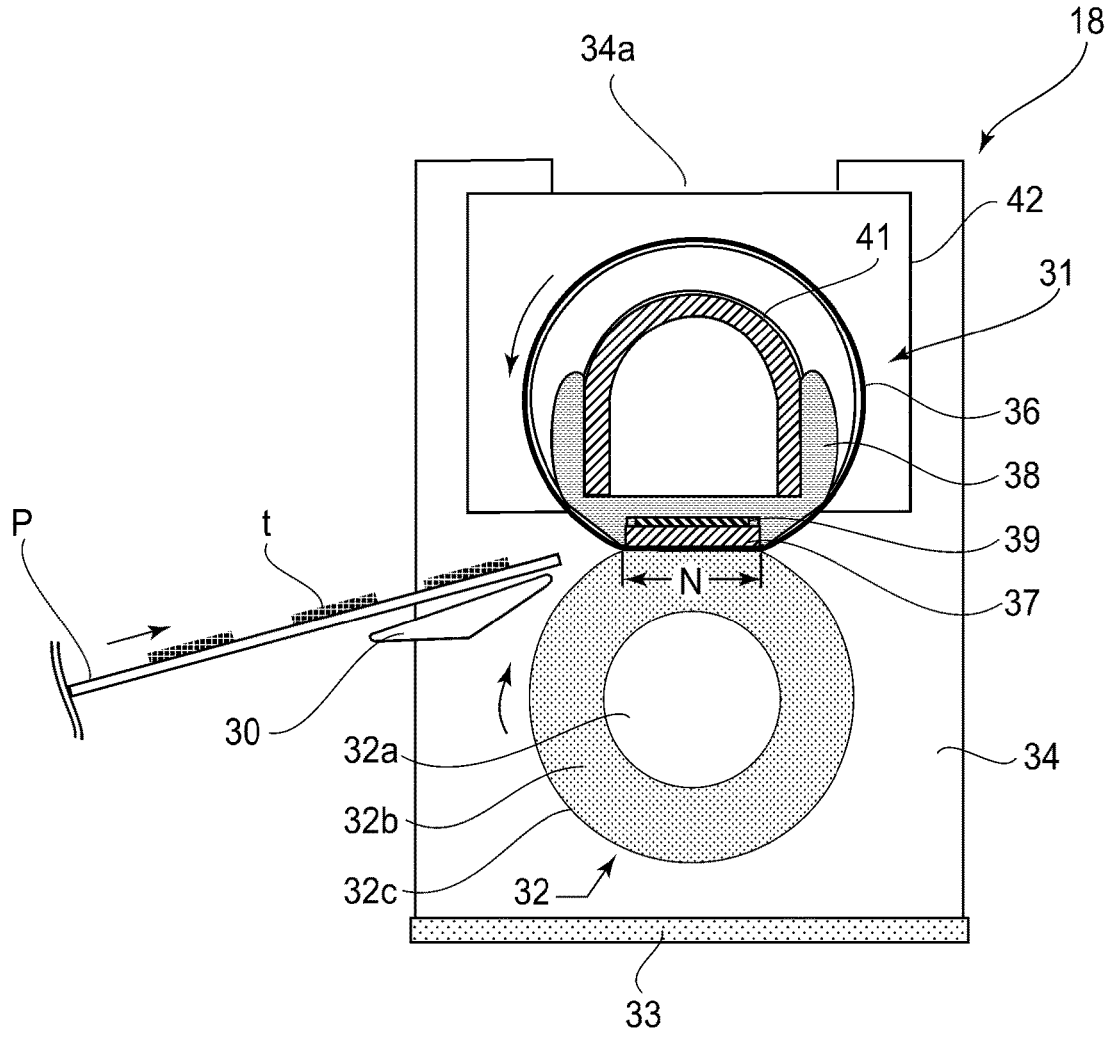
FIG. 1 is a schematic sectional view for illustrating a structure of a fixing device according to a First Embodiment of the present invention.
Figure 2:
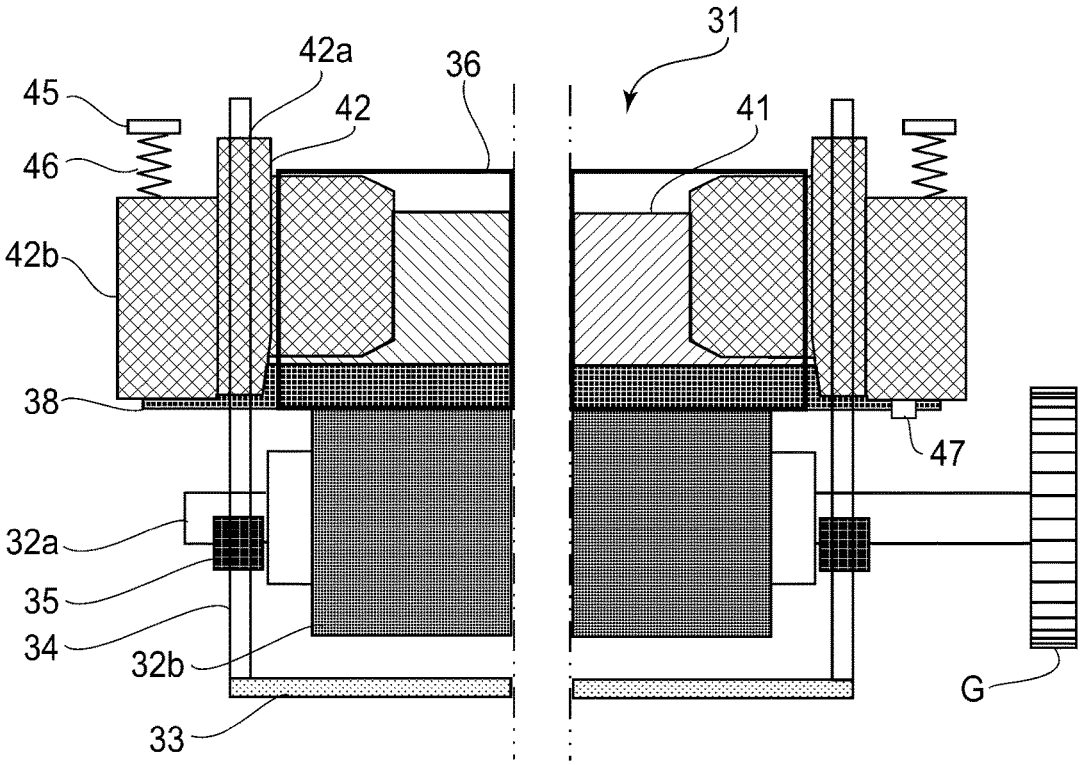
FIG. 2 is a schematic front view for illustrating the structure of the fixing device according to the First Embodiment of the present invention.

FIG. 1 is a schematic sectional view of a fixing device 18 in this embodiment as seen from the longitudinal direction of the fixing device 18, and FIG. 2 is a schematic view of the fixing device 18 at end portions of the fixing device 18.

The fixing device 18 includes a film unit 31 including a cylindrical film (endless belt) 36 having flexibility and includes a pressing roller 32 as a pressing member. The film unit 31 and the pressing roller 32 are provided substantially in parallel to each other between left and right side plates 34 of a device frame 33 so that a heater 37 opposes the pressing roller 32 through the rotatable sheet 36.

The pressing roller 32 includes a metal core 32*a*, an elastic layer 32*b* formed outside the metal core 32*a*, and a parting layer 32*c* formed outside the elastic layer 32*b*. This pressing roller 32 is provided as an opposing member opposing the film 36 backed up by the heater 37, and forms a nip N, for nipping and feeding a recording material P, carrying thereon a toner image, in cooperation with the film 36. As a material of the elastic layer 32*b* of the pressing roller 32, silicone rubber, fluorine-containing rubber, or the like, is used. As a material of the parting layer, tetrafluoroethylene-perfluoroalkylvinyl ether copolymer (PFA), polytetrafluoroethylene (PTFE), tetrafluoroethylene-hexafluoropropylene copolymer (FEP), or the like, is used.

In this embodiment, the pressing roller 32, prepared by forming an about 3.5 mm-thick silicone rubber elastic layer 32*b* on a stainless steel-made metal core 32*a* of 11 mm in outer diameter by injection molding, and then coating an outside of the layer 32*b* with an about 40 μm-thick PFA resin tube as a parting layer 32*c*, was used. An outer diameter of the pressing roller 32 is 18 mm. A hardness of the pressing roller 32 may desirably be, from the viewpoints of ensuring a durability of a nip N, in a range of 40 degrees to 70 degrees as measured by an Asker-C hardness meter under a load of 9.8 N. In this embodiment, the hardness is adjusted to 54 degrees.

A length of the elastic layer 32*b* of the pressing roller 32 measured in a longitudinal direction is 226 mm. The pressing roller 32 is, as shown in FIG. 2, supported rotatably between the side plates 34 of the device frame via bearing members 35 at end portions of the metal core 32*a*. At an end portion of the pressing roller metal core 32*a*, a driving gear G is fixed. To the driving gear G, a rotational force is transmitted from a driving source (not shown), so that the pressing roller 32 is rotationally driven.

The film unit 31, shown in FIG. 1, includes the film 36, a planar heater 37 contacting an inner surface of the film 36 and used as a heat generating member, a supporting member 38 for supporting the heater 37, and a metal plate 39, as a thermal capacity member, sandwiched between the supporting member 38 and the heater 37. The film unit 31 further includes a pressing stay 41 for reinforcing the supporting member 38, flanges 42 for limiting movement of the film 36 in the longitudinal position, and the like.

The film 36 includes a base layer, an elastic layer formed outside the base layer, and a parting layer formed outside the elastic layer, and is a cylindrical flexible member. The film 36 in this embodiment is 18 mm in inner diameter. In the film 36, as the base layer, a 60 μm-thick polyimide base material is used. As the elastic layer, an about 150 μm-thick silicone rubber layer is used. As the parting layer, a 15 mm-thick PFA resin tube is used.

The supporting member 38 has, as shown in FIG. 1, a substantially semicircular trough-like shape in cross section, and has rigidity, a heat-resistant property, and a heat-insulating property. In this embodiment, the supporting member 38 is formed of a liquid crystal polymer, or the like. The supporting member 38 has the function of supporting the inner surface of the film 36 externally fitted with the supporting member 38 and the function of supporting a surface of the heater 37.

Figure 3:
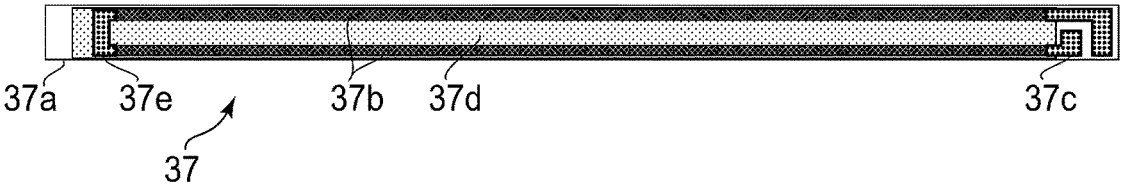
FIG. 3 is an illustration of a ceramic heater.

The heater 37 is, as shown in FIG. 3, prepared by forming two heat generating resistors 37*b* of silver-palladium alloy, or the like, on a substrate 37*a* of a ceramic material, such as alumina or aluminum nitride, by screen printing, or the like, and then connecting an electrical contact portion 37*c* of silver, or the like, with the heat generating resistors 37*b*. In this embodiment, the two heat generating resistors 37*b* are connected in parallel, and a resistance value is 18Ω. On the heat generating resistors 37*b*, a glass coat 37*d*, as a protective layer, is formed, whereby the heat generating resistors 37*b* are protected and a sliding property with the film 36 is improved.

The heater 37 has an elongated shape and is provided along a generatrix direction (longitudinal direction, first direction) of the film 36 while opposing a supporting surface of the supporting member 38 so that the longitudinal direction is the first direction. The substrate 37*a* of the heater 37 has a rectangular parallelopiped shape, which is 270 mm in length measured in the longitudinal direction, 5.8 mm in length measured in the short side direction, and 1.0 mm in thickness, and a material thereof is alumina. The upstream and downstream heat generating resistors 37*b* have a pattern such that the heat generating resistors 37*b* are connected with each other by an electrical contact portion at one end portion with respect to the longitudinal direction, and have the same shape, having a longitudinal length of 222 mm and a short-side length of 0.9 mm.

As regards short-side positions of the upstream and downstream heat generating resistors 37*b*, both the heat generating resistors 37*b* are disposed at positions of 0.7 mm from longitudinal edges of the ceramic substrate 37*a*, and the heat generating resistors 37*b* are printed at symmetrical positions with respect to a short-side center. Incidentally, onto the inner surface of the film 36, a heat-resistant grease is applied, so that a sliding property of the inner surface of the film 36 with the heater 37 and the supporting member 38 are improved.

Figure 4:
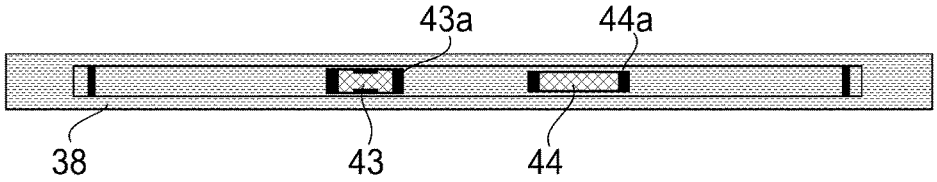
FIG. 4 is an illustration of a thermistor and a thermo switch.

FIG. 4 is a top (plan) view of the supporting member 38, a thermistor 43, as a temperature detecting element (that changes in electrical resistance with a temperature change), and a thermo switch 44, as an electrical power shut-off member (overheating suppressing element, or safety element) for shutting off electrical power supplied to the heater 37. The supporting member 38 is provided with placement windows 43*a* and 43*b* as openings corresponding to the thermistor 43 and the thermo switch 44, respectively, for permitting mounting and demounting of the thermistor 43 and the thermo switch 44. The thermistor 43 includes a temperature element provided on a metal plate 39 so as to sense (detect) heat of the heater 37 through the metal plate 39.

On the other hand, the thermo switch 44 is supported in direct contact with a back surface of the heater 37 so as to directly sense (detect) heat of the heater 37 through the metal plate 39. A pressing force (pressure) of the thermo switch 44 exerted on the back surface of the heater 37 is imparted by a spring (not shown) provided between the pressing stay 41 and a thermo switch holder (not shown) for holding the thermo switch 44.

The thermistor 42 is prepared by providing a thermistor element in a casing via ceramic paper, or the like, for stabilizing a contact state with the metal plate 39, and then coating the thermistor element with an insulating material, such as a polyimide tape. The thermo switch 44 is a part for detecting abnormal heat generation to shut off electrical power supply to the heater 37 when the heater 37 causes an abnormal temperature rise. The thermo switch 44 is provided with a bimetal portion prepared by firmly bonding two or more kinds of metal or alloy, different in thermal expansion coefficient to each other, and then finishing the bonded material in a plate shape, so that, due to abnormal high temperature of the heater 37, the metal portion having a large thermal expansion coefficient is bent toward the metal portion side having a small thermal expansion coefficient. By using this displacement, an electrical contact is opened and closed, so that a circuit for supplying electrical power (energization) to the heater 37 can be formed.

Next, the pressing stay 41, shown in FIG. 1, has a U-shape in cross section, and is an elongated member extending in the generatrix direction (longitudinal direction, layer direction) of the film 36. The function of the pressing stay 41 is to enhance the flexural rigidity of the film unit 31. The pressing stay 41 in this embodiment is formed by bending a 1.6 mm-thick stainless steel plate.

The left and right flanges 42 hold end portions of the pressing stay 41 with respect to the longitudinal direction, and a vertical groove portion 42*a* of each of the left and right flanges 42 is engaged with a vertical groove portion 34*a* of each of the left and right side plates 34 of the device frame 33. In this embodiment, as a material of the flanges 42, a liquid crystal polymer (resin) is used.

Then, as shown in FIG. 2, a pressing spring 46 is provided between a pressing arm 45 and a pressing portion 42*b* of each of the left and right flanges 42, so that the heater 37 is urged toward the pressing roller 32 via the left and right flanges 42, the pressing stay 41, the supporting member 38, and the film 36. In this embodiment, a press-contact force between the film 36 and the pressing roller 32 is 180N as a total pressure. As a result, the film 36, backed up by the heater 37, forms, together with the pressing roller 32, a nip N of about 6 mm.

During an operation of the fixing device, to the driving gear G of the pressing roller 32, a rotational force is transmitted from an unshown driving source, so that the pressing roller 32 is rotationally driven in the clockwise direction in FIG. 1 at a predetermined rotational speed. In this embodiment, the rotational speed of the pressing roller 32 was set so that a recording material feeding speed was 100 mm/sec. With the rotational drive of the pressing roller 32, the rotational force acts on the film 36 by a frictional force acting between the pressing roller 32 and the film 36 in the nip N. As a result, as shown in FIG. 1, the film 36 slides on a surface of the heater 37 while contacting the heater 37, and is rotated in the counterclockwise direction around the supporting member 38 by rotation of the pressing roller 32.

The film 36 is rotated and the electrical power is supplied to the heater 37, and, in a state in which the temperature of the heater 37 detected by the thermistor 43 reaches the target temperature, the recording material (recording paper) P is introduced. A fixing entrance guide 30 performs the function of guiding the recording material P, on which a toner image tin an unfixed state is formed, so as to be moved toward the nip N.

Into the nip N, the recording material P, having formed thereon the unfixed toner image t, is introduced, and then, a toner image-carrying surface of the recording material P is in close contact with the film 36 at the nip N and the recording material P is nipped and fed (conveyed) through the nip N. In this feeding process, the unfixed toner image t on the recording material P is heated and pressed by heat of the film 36 heated by the heater 37, and thus, is melted and fixed on the recording material P.

The recording material P passing through the nip N is curvature-separated from the surface of the film 36 and then is discharged to an outside of the fixing device by an unshown discharging roller pair. Incidentally, a maximum sheet passable width of the fixing device 18 is 216 mm, so that a LTR (letter)-sized recording material is capable of being subjected to printing at a speed of 20 PPM.

Feature of this Embodiment

Figure 5:
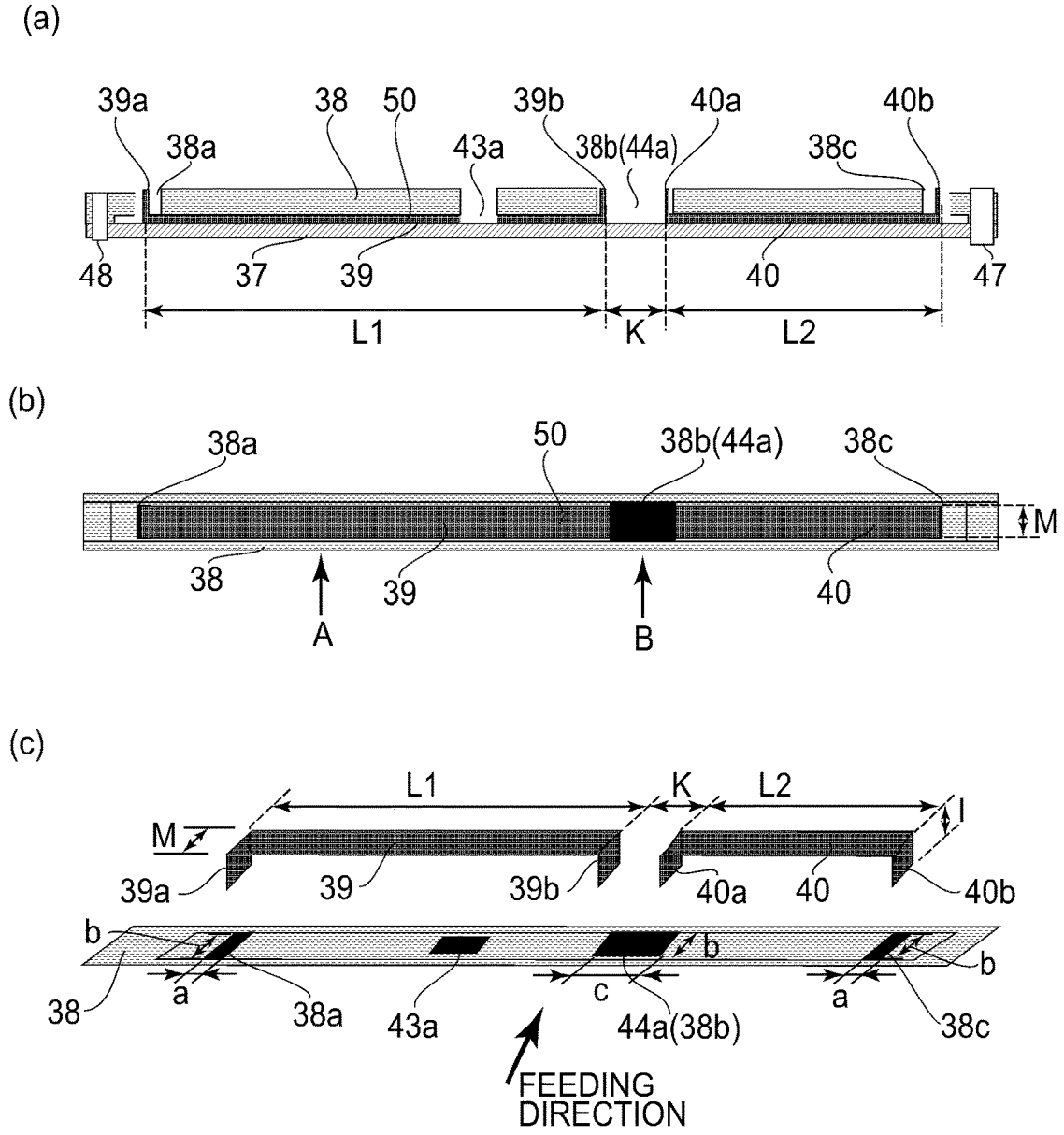
In FIG. 5, part (a) is a schematic view for illustrating a holding method of the heater and a metal plate in the First Embodiment, part (b) is a schematic view for illustrating holding method of the metal plate, and part (c) is a perspective view for illustrating an engaging portion of the position.
Figure 6:
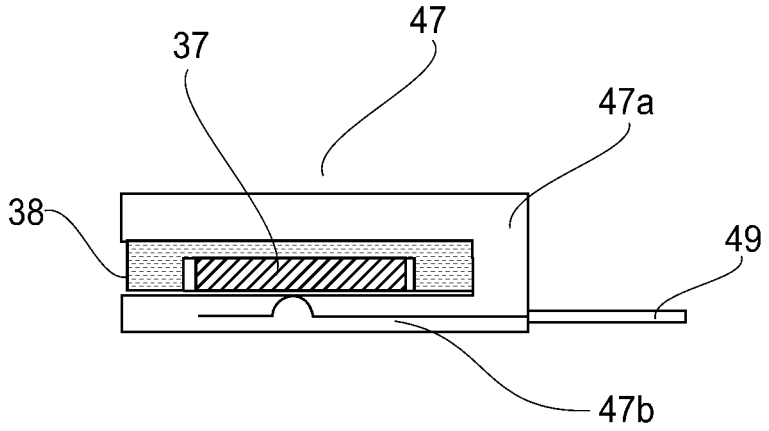
In FIG. 6, part (a) is an illustration of an energizing connector as a heater holding member, and part (b) is an illustration of a heater clip as the heater holding member.
Figure 6:
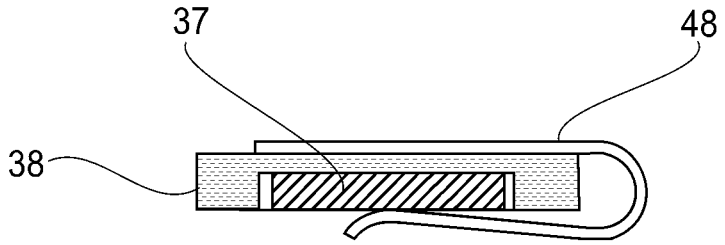

With reference to FIGS. 5 and 6, metal plates 39 and 40, as thermally capacitive members in this embodiment, and a holding method thereof will be described. In FIG. 5, part (a) is a longitudinal sectional view of the heater 37 and the metal plates 39 and 40, part (b) is a schematic view showing a state in which the metal plates 39 and 40 are provided on the supporting member 38 in a state in which the heater 37 is removed, and part (c) is a perspective view for illustrating a metal plate engaging portion. Incidentally, in FIG. 5, illustration of the thermistor 43 and the thermo switch 44 is omitted.

As shown in parts (a) and (b) of FIG. 5, in this embodiment, the metal plates 39 and 40 are mounted on the supporting member 38, and the heater 37 is mounted on the metal plates 39 and 40. Further, as shown in parts (a) and (b) of FIG. 6, the longitudinal end portion of the heater 37 is held by an energizing connector 47 and a heater clip 48, respectively, which are end portion holding members, and are held in contact with an associated longitudinal end portion of the supporting member 38. A longitudinal central portion of the heater 37 is supported by the supporting member 38 via the metal plates 39 and 40 (part (a) of FIG. 5), and the longitudinal end portion of the heater 37 is supported in contact with the supporting member 38 (parts (a) and (b) of FIG. 6).

As shown in part (a) of FIG. 6, the energizing connector 47 is constituted by a housing portion formed of a resin member in a U-shape and by a contact terminal 47*b*. The energizing connector 47 holds the heater 37 and the supporting member 38 while sandwiching these members, and the contact terminal 47*b* contacts an electrode 37*c* (FIG. 3) of the heater 37, and thus, the energizing connector 47 is electrically connected with the heater 37. In this embodiment, the energizing connector 47 was used as the end portion holding member for holding the heater 37, but its function may be divided into the function of energizing the heater 37 and the function as the end portion holding member for the heater 37, and thus the energizing connector 47 may also be constituted by separate members. In part (a) of FIG. 6, the contact terminal 47*b* is connected with a bundle wire 49, and the bundle wire 49 is connected with an unshown alternating current (AC) power source and a triac.

As shown in part (b) of FIG. 6, the heater clip 48 is formed of a metal plate bent in a V-shape, and is used as an end portion holding member for holding the heater 37 based on its spring property, and holds the heater 37 by causing the end portion of the heater 37 to contact the supporting member 38. Further, the longitudinal end portion of the heater 37, pressed by the heater clip 48, is movable in an in-plane direction of the heater sliding surface. As a result, during thermal expansion of the heater 37, exertion of unnecessary stress on the heater 37 is prevented.

With reference to part (c) of FIG. 5, the metal plates 39 and 40 and engaging portions provided in the supporting member 38 will be described. In this embodiment, as the metal plates 39 and 40, an aluminum plate having a constant thickness of 0.3 mm is used. Each of the aluminum plates 39 and 40 includes a contact portion contacting the heater 37 and having a feeding direction width M of 4 mm. A width with respect to the longitudinal direction is L1=161 mm for the aluminum plate 39, and is L2=79 mm for the aluminum plate 40.

The aluminum plate 39 includes a first surface contacting the back surface of the heater 37, and bent portions 39*a* and 39*b*, which are second surfaces (surfaces extending from longitudinal ends of the first surface in a direction of being spaced from the heater 37 (opposite direction from the heater 37)) provided at longitudinal end portions thereof, and which are bent at right angle with a length l=3 mm. The bent portions 39*a* and 39*b* are inserted in mounting holes 38*a* and 38*b*, respectively, provided as openings in the supporting member 38, so that movement of the aluminum plate 39 is prevented. Similarly, the aluminum plate 40 includes bent portions 40*a* and 40*b* provided as second surfaces at longitudinal end portions thereof, and the bent portions 40*a* and 40*b* are inserted in mounting holes 38*b* and 38*c*, respectively.

The mounting holes 38*a* and 38*c* have the same size and are provided to have a relatively greater size (error amount Δ of 1 mm or less) than the associated bent portions in order to absorb thermal expansion of the aluminum plates 39 and 40. In this embodiment, a=0.4 mm and b=4.1 mm are set. The mounting hole 38*b* for mounting the supporting member 38 on a device frame 33 also functions as the placement window 44*a* in a state in which the supporting member 38 is demounted from the device frame 33, and, in this embodiment, b=4.1 mm and c=15.1 mm are set. Thus, a constitution in which the thermo switch 44 is provided at a position corresponding to a second region of the heater 37 in which the heater 37 does not contact the aluminum plate 39, and the supporting member 38 is provided at a position corresponding to the second region, with the mounting hole 38*b* for preventing movement of the aluminum plate 39, and supports the heater 37 via the aluminum plate 39, is employed. That is, the supporting member 38 is provided with the placement window 44*a* at a portion corresponding to the second region, in which the heater 37 does not contact the aluminum plate 39, different from the first region in which the heater 37 contacts the aluminum plate 39, with respect to the longitudinal direction of the heater 37.

Figure 7:
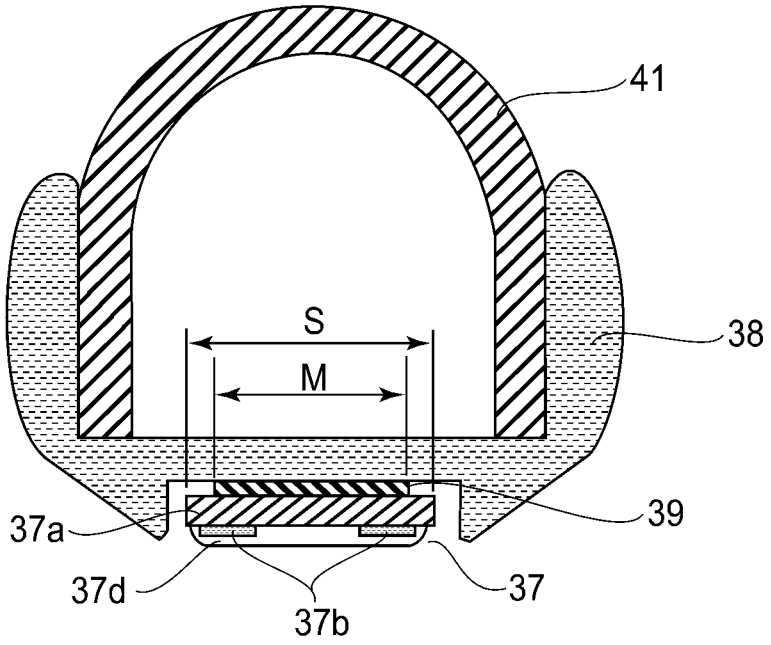
In FIG. 7, part (a) is a schematic sectional view for illustrating positions of the heater and the metal plate in the First Embodiment, and part (b) is a schematic sectional view of the thermo switch.
Figure 7:
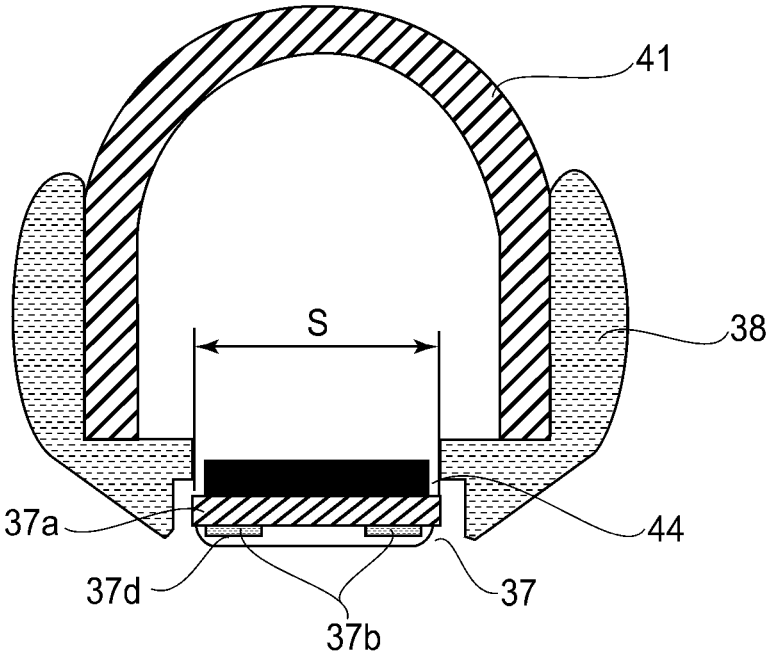

Parts (a) and (b) of FIG. 7 are sectional views of the fixing device 18 in this embodiment as seen in the longitudinal direction of the fixing device 18. Part (a) of FIG. 7 is the sectional view taken along an arrow A of part (b) of FIG. 5. The heater 37 is received by the aluminum plate 39 on the supporting member 38. A heater substrate width S is 5.8 mm, and a feeding direction width M of the aluminum plate 39 is 4 mm. Further, part (b) of FIG. 7 is the sectional view of the fixing device in a gap between the aluminum plates 39 and 40 taken along an arrow B of part (b) of FIG. 5. In a gap K between the aluminum plates 39 and 40, the thermo switch 44 is disposed and directly contacts the heater 37 without via the aluminum plate. That is, between the heater 37 and the thermo switch 44, heat conduction between the heater 37 and the thermo switch 44 during normal use, is suppressed.

The thickness of the aluminum plates 39 and 40 is 0.3 mm, and, therefore, when the above-described error amount Δ is taken into consideration, as regards the gap K between the aluminum plates 39 and 40, the following formula is satisfied:

$$K+0.3\times2+\Delta=15.1.$$

Action of this Embodiment

Figure 8:
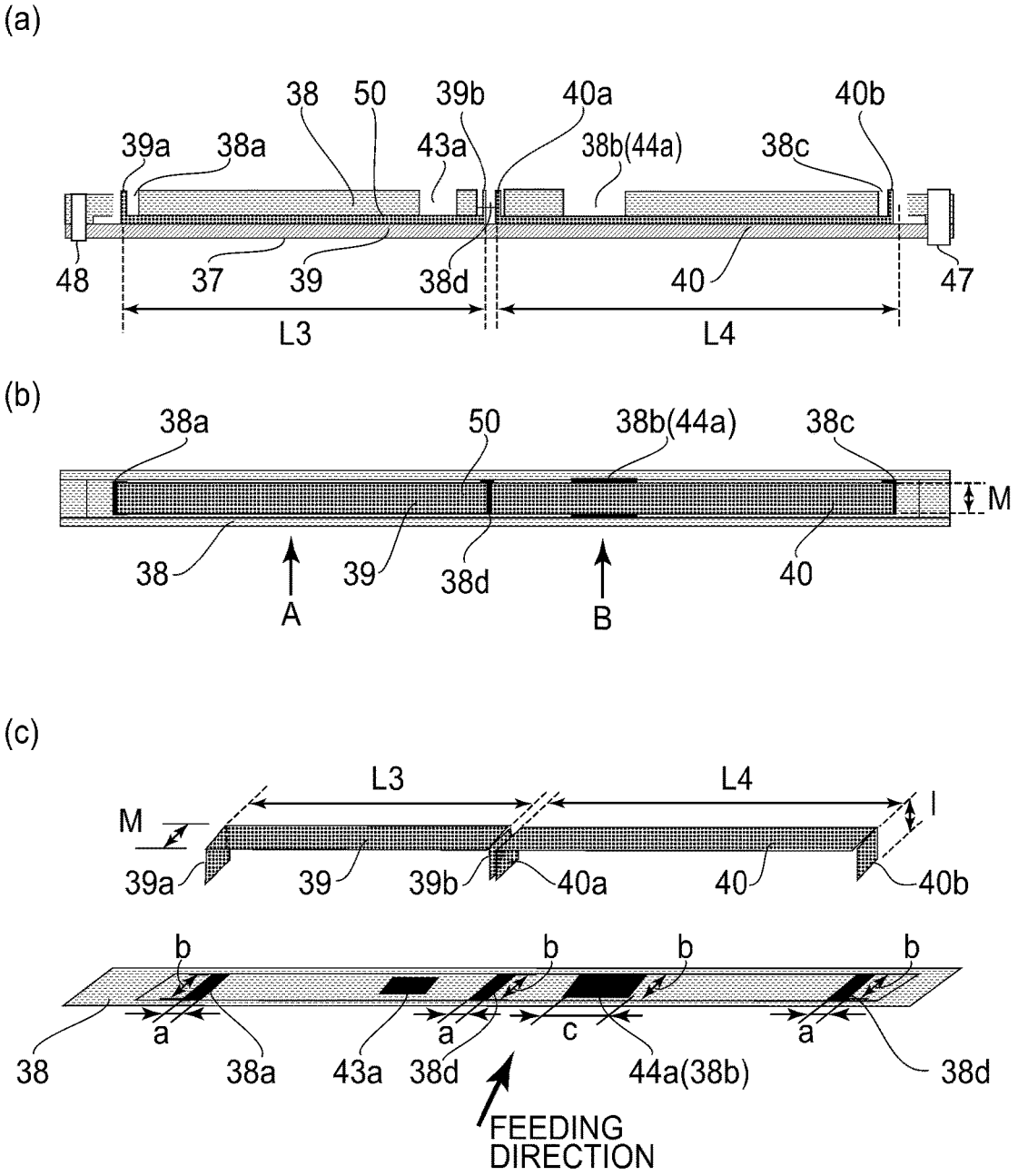
In FIG. 8, part (a) is a schematic view for illustrating a holding method of a heater and a metal plate in a comparison example, part (b) is a schematic view for illustrating a holding method of the metal plate in the comparison example, and part (c) is a perspective view for illustrating an engaging portion of the metal plate in the comparison example.
Figure 9:
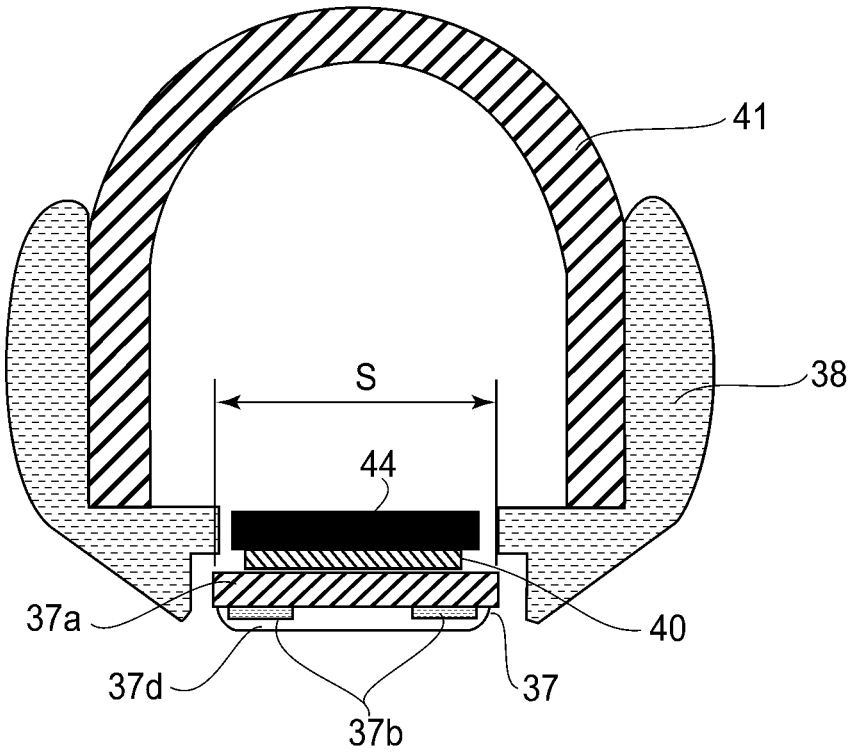
FIG. 9 is a schematic sectional view of a thermo switch portion in the comparison example.

Parts (a) to (c) of FIG. 8 are schematic views of a heater and metal plates in a comparison example, in which part (b) is the schematic view of the members with respect to the longitudinal direction, part (b) is the schematic view showing a state in which the aluminum plates 39 and 40 are provided on the supporting member 38 in a state that the heater 37 is removed, and part (c) is a perspective view for illustrating engaging portions of the aluminum plates 39 and 40. In this comparison example, the aluminum plate 39 contacts the thermistor 43, and the aluminum plate 40 contacts the thermo switch 44. The bent portion 40*a* of the aluminum plate 40 is inserted in a mounting hole 38*d* different from the placement window 44*a* of the thermo switch 44. FIG. 9 is a sectional view of a gap between the aluminum plates taken along an arrow B of part (b) of FIG. 8.

Figure 10:
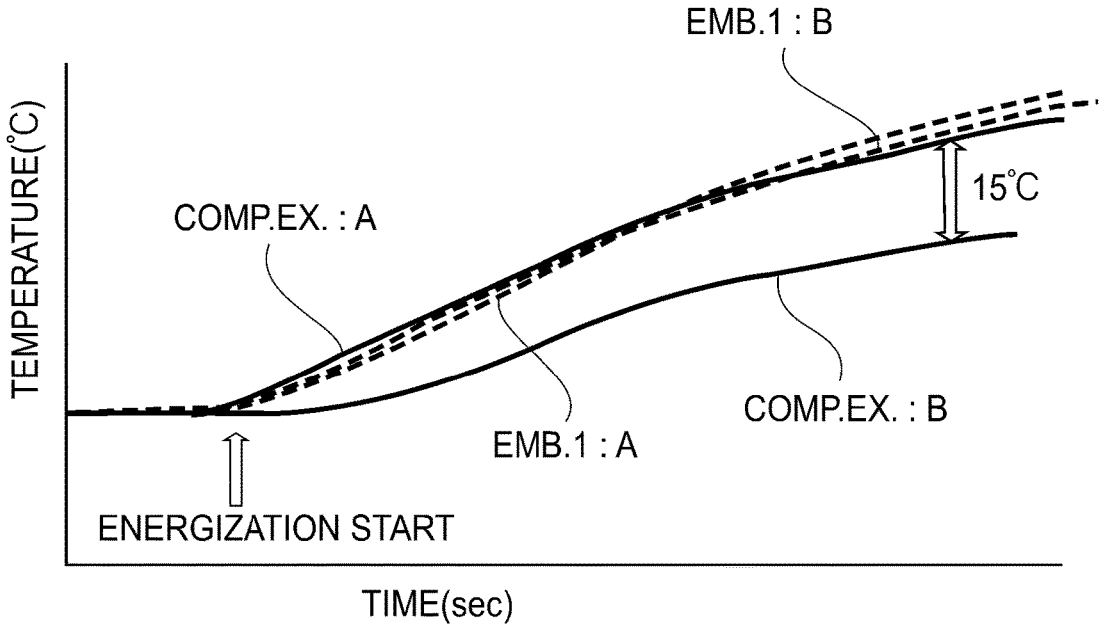
FIG. 10 is a graph showing roller back surface temperature changes at positions of the thermo switches in the First Embodiment and the comparison example.

FIG. 10 shows heater back surface temperature changes at thermo switch positions in this embodiment and the comparison example. In FIG. 10, heater back surface temperatures from a start of energization to the heaters are measured by a thermocouple (that changes in electromotive force with a temperature change) mounted on the back surface of the heater 37 at a central portion with respect to a recording material feeding direction. Further, with respect to the longitudinal direction (first direction), the temperatures at portions A and B of part (b) of FIG. 5 in this embodiment, and the temperatures at portions A and B of part (b) of FIG. 8 in the comparison example were measured.

In the comparison example, when the heater back surface temperatures of the heater 37, after a lapse of 3 seconds from the start of energization, are such that the temperature at the portion B is less than the temperature at the portion A by about 17° C., and, on the other hand, in this embodiment, the temperature at the portion B is merely less than the temperature at the portion A by about 2° C. to 3° C. The portions A in this embodiment and the comparison example are unchanged in constitution between this embodiment and the comparison example, and, therefore, the temperature changes at the portions A are substantially the same. When a comparison is made at the portions B, it is understood that the heater back surface temperature in this embodiment greater by about 15° C. than the heater back surface temperature in the comparison example.

As a result of printing of the image in this state, in the comparison example, improper fixing generated at the thermo switch 44 portion in printing of the image on a first sheet. This is because the back surface temperature of the heater 37 locally becomes a low temperature, so that the film surface temperature at this portion also lowers. When the film surface temperature in the comparison example was measured using a radiation thermometer, it turned out that, immediately before the printing of the image on the first sheet, the temperature at the portion B was less by about 5° C. than at the portion A.

The improper fixing remarkably generates immediately after the fixing device 18 is increased in temperature up to a fixing temperature from a state of being sufficiently cooled at normal temperature, and, when the printing is repeated, the heater back surface temperature is uniformized, and, therefore, the improper fixing gradually does not generate. In the comparison example, the improper fixing slightly generates in the printing of the image on a second sheet and disappears in the printing of the image on a third sheet.

On the other hand, in this embodiment, the heater back surface temperature was uniform compared with that in the comparison example, so that the improper fixing did not generate even in the printing of the image on the first sheet and a good image was able to be obtained. This is because, by disposing the aluminum plate on the heater back surface at a position other than the position of the thermo switch 44, the temperature is controlled in a state in which values of thermal capacitance at portions in which the thermo switch 44 is present and absent are added to each other, and thus, a local temperature lowering does not generate at the position of the thermo switch 44.

Figure 11:
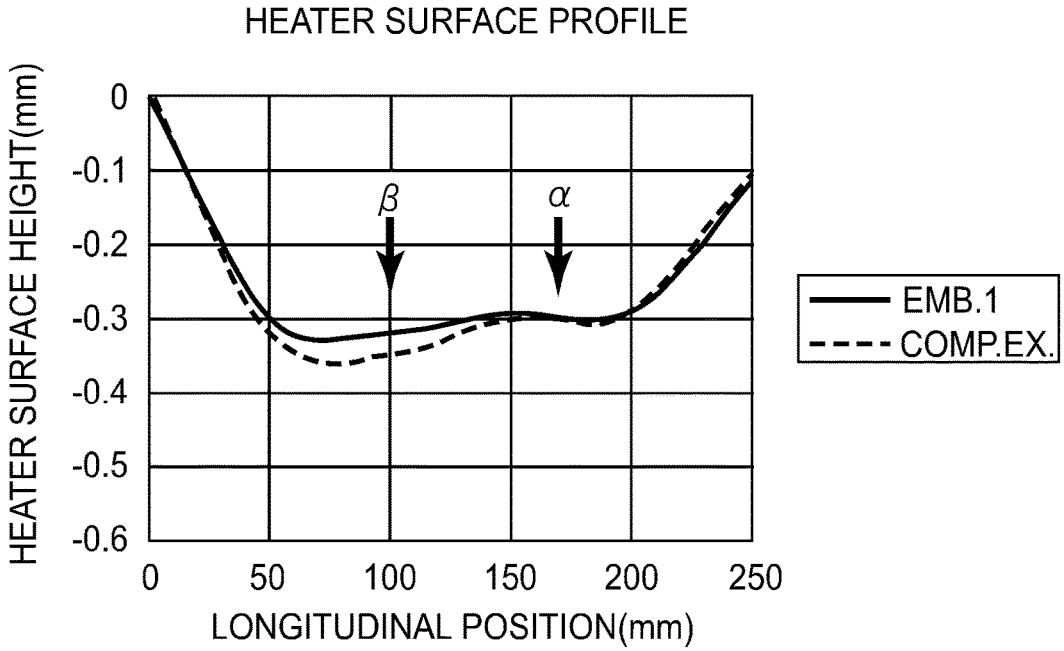
FIG. 11 is a graph showing heat profiles on heater surfaces in the First Embodiment and the comparison example.

Strength of the supporting member 38 will be described using FIG. 11. FIG. 11 is a graph showing a result of measurement of a height of a surface of the heater 37 when a voltage of 145 V is applied for about 7 seconds on the assumption of temperature rise of the heater 37 due to voltage source (power) circuit failure. An arrow α shows a heater surface height at a position of the placement window 44*a* in which the thermo switch 44 is disposed. On the other hand, an arrow β shows a heater surface height at a position of the mounting hole 38*d* in the comparison example.

At the arrow α portion, there is no difference in heater surface height between this embodiment and the comparison example, so that a sag of the supporting member 38 does not generate. This would be considered because the thermo switch 44 backs up the sheet 38 in press-contact with the back surface of the heater 37 and thus, suppresses the sag of the supporting member 38.

On the other hand, the heater surface height at the arrow β portion in the comparison example is lower by about 0.03 mm than that in this embodiment. This is because the mounting hole 38*d* is provided at the arrow β portion in the comparison example and the strength of the supporting member 38 weakens from the mounting hole 38*d* as a starting point, and thus, deformation of the supporting member 38 occurs due to the sag in the neighborhood of the mounting hole 38*d*.

As described above, in this embodiment, the metal plate is disposed as a thermal capacitance member on the heater back surface at the position other than the position of the thermo switch 44, and the temperature is controlled in a state in which values of thermal capacity at portions in which the thermo switch 44 is present and absent are added to each other, so that a local temperature lowering at the position of the thermo switch 44 is avoided.

Further, in this embodiment, the supporting member 38 is provided with the opening, corresponding to the thermo switch 44, at the position opposing the second region different in position with respect to the longitudinal direction (first direction) of the heater 37 from the first region in which the heater 37 contacts the aluminum plate 39. By contact between a second surface of the aluminum plate 39 and an end surface of the opening of the supporting member 38 with respect to the first direction, movement of the aluminum plate 39 relative to the supporting member 38 is prevented. Further, the aluminum plate 39 is constituted so that the portion corresponding to the second region of the heater 37 contacts the thermo switch 44. Further, the positioning hole of the metal plate relative to the metal plate is caused to function as the B placement window (opening) of the thermo switch 44, so that the sag caused by the lowering in strength of the supporting member 38 due to the positioning hole is avoided.

As a result, the generation of the improper fixing due to the local temperature lowering of the heater (heat generating member) while maintaining a heat-uniformizing effect by a conventional high heat conductive member, and the sag of the heater supporting member due to the lowering in strength of the supporting member is avoided, so that a good image can be formed.

Second Embodiment

In the First Embodiment, the constitution in which the thermo switch was directly contacted to the back surface of the heater without via the metal plate, so as to suppress the heat conduction between the heater and the thermo switch during normal use, was employed. In this embodiment, in order to further suppress the heat conduction between the heater and the thermo switch during normal use, a spacer member is used between the heater and the thermo switch. An outline of a fixing device in this embodiment is the same as that of the fixing device in the First Embodiment, and, therefore, is omitted, and only a feature of this embodiment will be described.

Feature of this Embodiment

Figure 12:
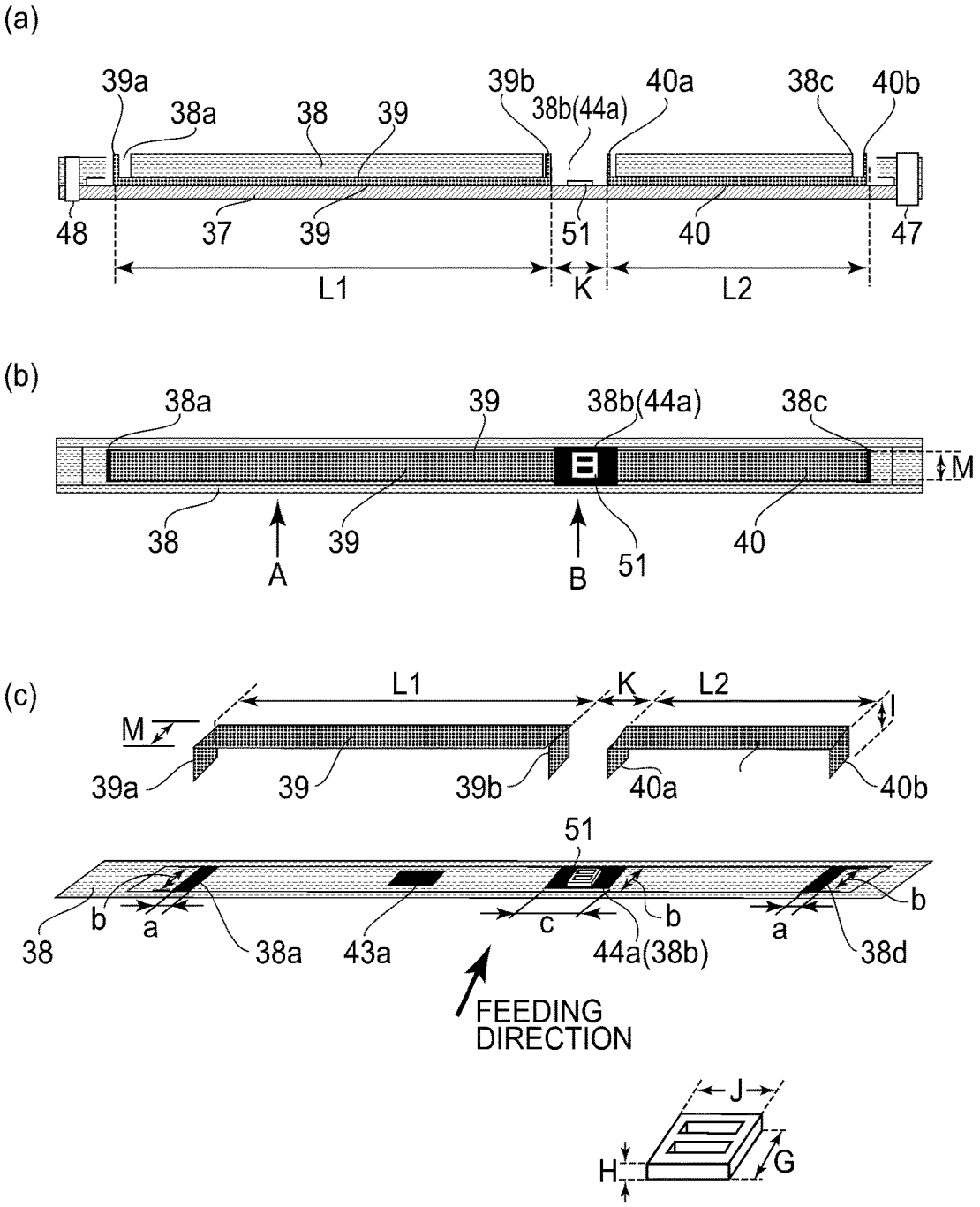
In FIG. 12, part (a) is a schematic view for illustrating a holding method of the heater and a metal plate in a Second Embodiment, part (b) is a schematic view for illustrating holding method of the metal plate, and part (c) is a perspective view for illustrating an engaging portion of the position.

Parts (a) to (c) of FIG. 12 are schematic views for illustrating the heater and metal plates in this embodiment, in which part (b) is a longitudinal sectional view of the heater and the metal plates in this embodiment, part (b) is the schematic view of a state in which the aluminum plates 39 and 40 are provided on the supporting member 38 in a state that the heater 37 is removed, and part (c) is a perspective view for illustrating an aluminum plate engaging portion and the spacer member. In part (c) of FIG. 12, a spacer member (spacer) 51 for the thermo switch 44 is disposed between the aluminum plates 39 and 40 and may preferably have a heat-resistant property capable of withstanding a normal temperature of the heater 37 and thermal capacity equal to or less than the thermal capacity of the supporting member 38.

The thermo switch 44 has large thermal capacity, and, therefore, the heat of the heater 37 does not readily conduct to the fixing film 36 contacting the (front) surface of the heater 37 compared with other members (the supporting member 38 and the thermistor 43) disposed on the back surface side of the heater 37. As a result, fixing non-uniformity and uneven glossiness of the toner image t on the recording material P can occur. In this embodiment, the spacer 51, formed of a resin material, for the thermo switch 44 is sandwiched between the heater 37 and the thermo switch 44, so that the thermo switch 44 and the back surface of the heater 37 are placed in a non-(direct) contact state.

Figure 13:
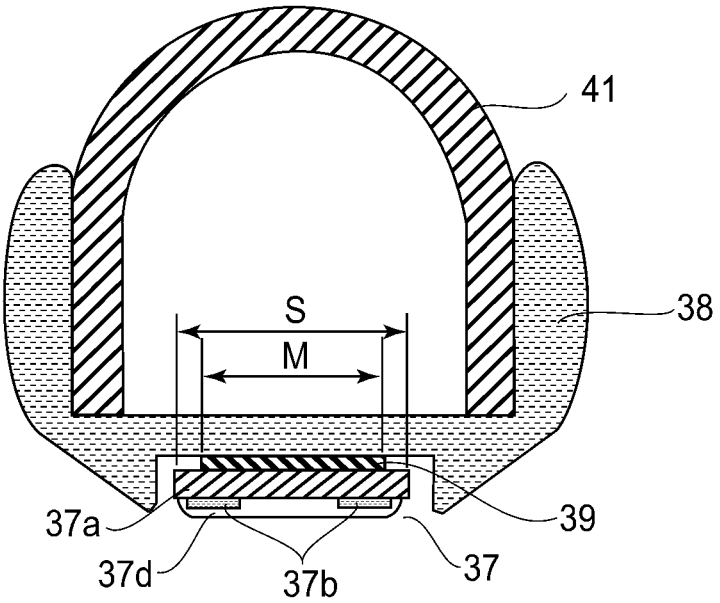
In FIG. 13, part (a) is a schematic sectional view for illustrating positions of the heater and the metal plate in the Second Embodiment, and part (b) is a schematic sectional view of the thermo switch.
Figure 13:
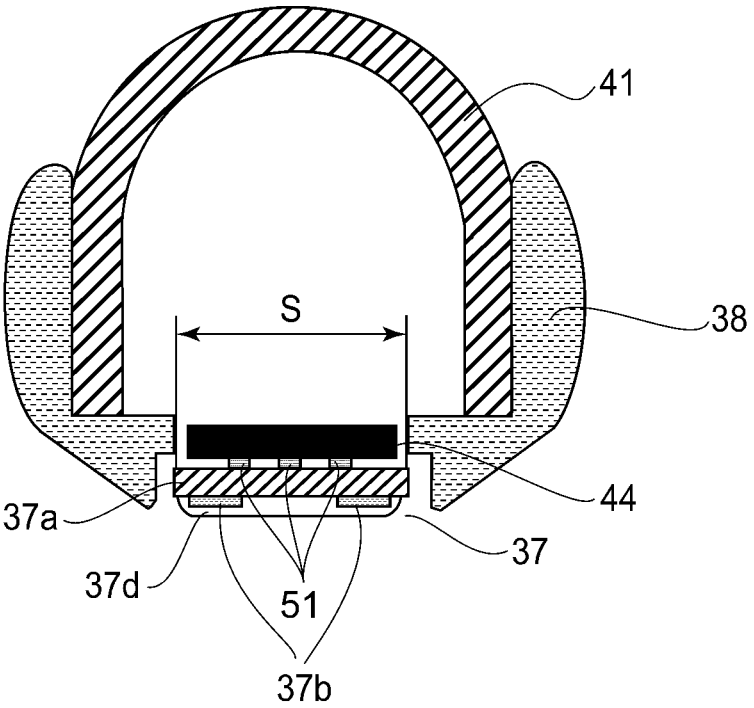

As a result, a gap between the heater 37 and the thermo switch 44 is fixed while suppressing the heat conduction between the heater 37 and the thermo switch 44, so that the thermo switch 44 can be stably operated while eliminating the fixing non-uniformity and the uneven glossiness of the toner image t on the recording material P. Parts (a) and (b) of FIG. 13 are sectional views of arrows A and B portions, respectively, of FIG. 12.

A size of the spacer 51 is J=4 mm in width measured in the longitudinal direction (first direction), G=3 mm in width measured in the recording material feeding direction, and H=0.5 mm in height. Further, via the spacer 51, the thermo switch 44 is supported so as to be pressed toward the back surface of the heater 37. That is, the supporting member 38 is constituted so that the thermo switch 44 and the spacer 51 are in contact with each other at a portion corresponding to the second region different from the first region, in which the heater 37 contacts the aluminum plate 39, with respect to the longitudinal direction of the heater 37. In this embodiment, as a material of the spacer 51, a liquid crystal polymer (LCP) was used.

Action of this Embodiment

A comparison example compared with this embodiment is the same as the comparison example compared with the First Embodiment and shown in FIGS. 8 and 9.

Figure 14:
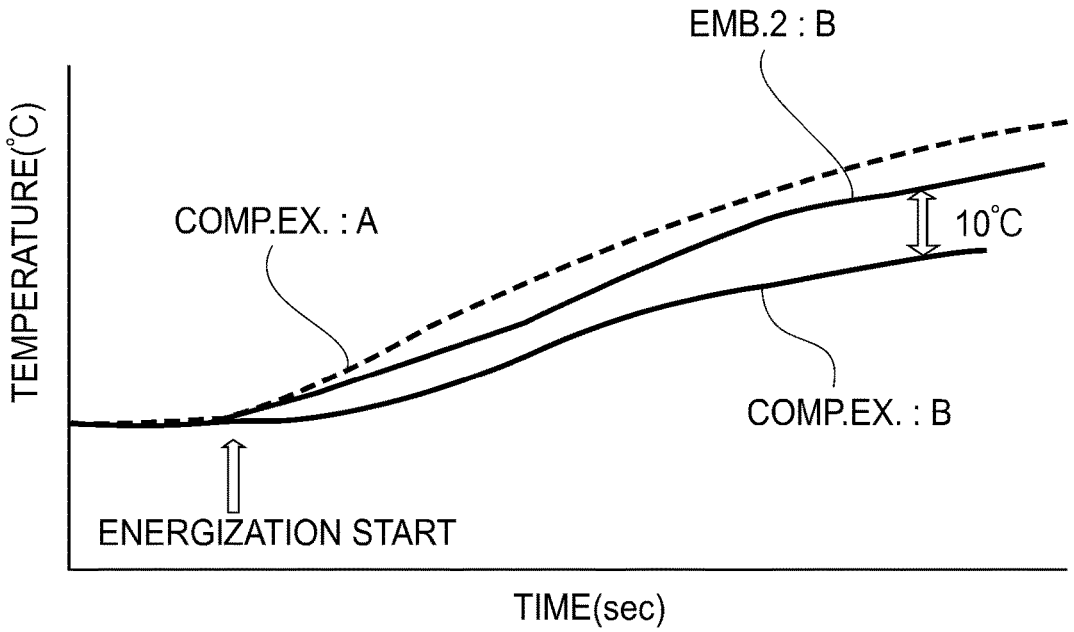
FIG. 14 is a graph showing roller back surface temperature changes at positions of the thermo switches in the Second Embodiment and the comparison example.

FIG. 14 shows heater back surface temperature changes at thermo switch positions in this embodiment and the comparison example. In this embodiment, the temperatures at portions A and B of part (b) of FIG. 5 are measured, and in the comparison example, the temperatures at portions A and B of part (b) of FIG. 8 are measured. The portions A in this embodiment and the comparison example are unchanged in constitution between this embodiment and the comparison example, and the temperature changes at the portions A are substantially the same, and, therefore, the temperature change at the portion A in this embodiment is omitted. When comparison is made at the portions B, it is understood that the heater back surface temperature in this embodiment greater by about 10° C. than the heater back surface temperature in the comparison example.

As a result of printing of the image in such a state, in the comparison example, improper fixing generated at a position of the thermo switch 44 portion in printing of the image on a first sheet, and slightly generates in the printing of the image on a second sheet and disappears in the printing of the image on a third sheet.

On the other hand, in this embodiment, the heater back surface temperature was uniform compared with that in the comparison example, so that the improper fixing did not generate even in the printing of the image on the first sheet and a good image was able to be obtained. This is because the thermo switch 44 and the back surface of the heater 37 are in a non-contact state by the spacer 51 and thus, the heat conduction between the heater 37 and the thermo switch 44 is suppressed with the result that a local temperature lowering at the position of the thermo switch 44 is suppressed.

Figure 15:
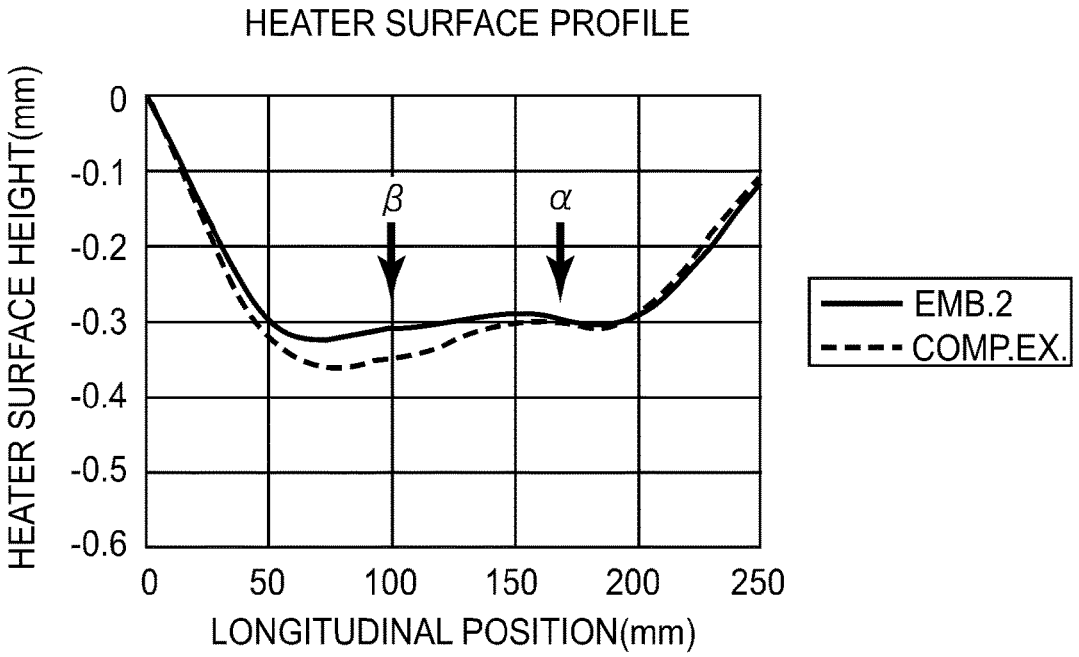
FIG. 15 is a graph showing heat profiles on heater surfaces in the Second Embodiment and the comparison example.

Strength of the supporting member 38 will be described using FIG. 15. FIG. 15 is a graph showing a result of measurement of a height of a surface of the heater 37 when a voltage of 145 V is applied for about 7 seconds on the assumption of temperature rise of the heater 37 due to voltage source (power) circuit failure, similarly as in the First Embodiment. An arrow α shows a heater surface height at a position of the placement window 44*a* in which the thermo switch 44 is disposed, and an arrow β shows a heater surface height at a position of the mounting hole 38*d* (FIG. 8) in the comparison example.

At the arrow α portion, there is no difference in heater surface height between this embodiment and the comparison example, so that a sag of the supporting member 38 does not generate.

The heater surface height at the arrow β portion in the comparison example is lower by about 0.05 mm than that in this embodiment. This is because, similarly as in the comparison example described in First Embodiment, the mounting hole 38*d* is provided at the arrow β portion in the comparison example and the strength of the supporting member 38 weakens from the mounting hole 38*d* as a starting point, and thus, deformation of the supporting member 38 occurs due to the sag in the neighborhood of the mounting hole 38*d*.

As described above, in this embodiment, the metal plate is disposed as a thermal capacitance member on the heater back surface at the position other than the position of the thermo switch 44, and the temperature is controlled in a state in which values of thermal capacity at portions in which the thermo switch 44 is present and absent are added to each other, so that a local temperature lowering at the position of the thermo switch 44 is avoided.

Further, in this embodiment, the spacer member is provided between the heater and the thermo switch, so that the heat conduction between the heater and the thermo switch during normal use can be further suppressed.

Further, the positioning hole of the metal plate relative to the metal plate is caused to function as the B placement window of the thermo switch 44, so that the sag caused by the lowering in strength of the supporting member 38 due to the positioning hole can be avoided.

As a result, the generation of the improper fixing due to the local temperature lowering of the heater (heat generating member) while maintaining a heat-uniformizing effect by a conventional high heat conductive member, and the sag of the heater supporting member due to the lowering in strength of the supporting member is avoided, so that a good image can be formed.

Modified Embodiments

In the above description, preferred embodiments of the present invention were described. The present invention is not limited, however, to these embodiments, and can be variously modified and changed within the scope of the present invention.

Modified Embodiment 1

In the above-described embodiments, the bent portions 39*b* and 40*b*, as the second surfaces of the heat conductive members 39 and 40 including the first surface contacting the heater, were used as the positioning portions positioned relative to the opening 44*a* of the supporting member 38, but the present invention is not limited thereto.

Positioning members corresponding to the bent portions 39 and 40*b* as the second surfaces of the heat conductive members 39 and 40 are provided integrally with the heat conductive members 39 and 40, and may also be positioned relative to the opening 44*a* of the supporting member 38. In this case, the positioning members are not necessarily required to have heat conductivity, and may also be formed of, for example, a resin member, rather than the metal material. Further, as regards the heat conductive members 39 and 40, the first surface contacting the heater and the second surfaces (39*a*, 40*a*) as the positioning portions have the same thickness, but the positioning members may also have a thickness different from (for example, greater than) the thickness of the first surface of the heat conductive members contacting the heater.

Modified Embodiment 2

In the above-described embodiments, a description was made on the presumption that a heat generation distribution of the heat generating resistor with respect to the longitudinal direction (first direction) of the heater, as the heat generating member, was uniform, but the present invention is not limited thereto. The shape of the heat generating resistor may also be changed so that an amount of heat generation is greater at the position of the thermo switch 44 than at another position with respect to the longitudinal direction (first direction). As a result, the generation of the improper fixing due to the local temperature lowering of the heater (heat generating member) can be further suppressed.

Modified Embodiment 3

In the above-described embodiments, the thermo switch 44, as the electrical power shut-off member for suppressing overheating of the heater, as the heat generating member, was described, but the present invention is not limited thereto, and another element having a large thermal capacity can be used.

Modified Embodiment 4

In the above-described embodiments, as the opposing member, the pressing roller for pressing the endless belt was used, but the endless belt may also be used as the opposing member. The opposing member is not limited to an opposing member for pressing the endless belt as the rotatable fixing member, but may also be an opposing member to be pressed.

Modified Embodiment 5

In the above-described embodiments, as the recording material, the recording paper was described, but the recording material in the present invention is not limited to the paper. In general, the recording material is a sheet-like member on which the toner image is formed by the image forming apparatus and includes, for example, regular or irregular materials, such as plain paper, thick paper, thin paper, an envelope, a postcard, a seal, a resin sheet, an overhead projector (OHP) sheet, and glossy paper. In the above-described embodiments, for convenience, handling of the recording material P was described using terms such as the sheet passing or the sheet discharge, but by these terms, the recording material in the present invention is not limited to the paper.

Modified Embodiment 6

In the above-described embodiments, the fixing device for fixing the unfixed toner image on the sheet was described as an example, but the present invention is not limited thereto. The present invention is also similarly applicable to a device for heating and pressing a toner image temporarily fixed on the sheet in order to improve a gloss (glossiness) of an image (also in this case, the device is referred to as the fixing device).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A fixing device comprising:

an elongated heat generating member extending in a longitudinal direction, and having a first region, and a second region provided in a position that is different from a position of the first region in the longitudinal direction;

an endless belt rotatable and in contact with said heat generating member;

an opposing member opposing said endless belt, and being configured to form a nip in cooperation with said endless belt so that a recording material, on which a toner image is formed, is nipped and fed in the nip;

a heat conductive member extending in the longitudinal direction within the first region in which a surface of said heat conductive member contacts said heat generating member;

a positioning portion provided at an end portion of said heat conductive member with respect to the longitudinal direction, so as to extend in a direction in which said positioning portion is spaced apart from said heat generating member;

a supporting member provided with a positioning portion opening at a position corresponding to the second region, and being configured to support said heat generating member via said heat conductive member; and an electrical power shut-off member located in said positioning portion opening of said supporting member, and being configured to shut off electrical power supplied to said heat generating member, wherein said positioning portion is configured to be inserted into said positioning portion opening of said supporting member to prevent movement of said heat conductive member.

2. The fixing device according to claim 1, wherein said heat conductive member is formed of a metal material.

3. The fixing device according to claim 1, wherein said electrical power shut-off member is configured to contact said heat generating member in the second region.

4. A fixing device according to claim 3, further comprising a temperature detecting element provided in contact with said heat generating member via said heat conductive member in a third region of said heat generating member, the third region being provided in a position different from that of the first region and the second region with respect to the longitudinal direction, and said temperature detecting element being configured to detect a temperature of said heat generating member.

5. The fixing device according to claim 4, wherein said supporting member is provided with a temperature detecting element opening at a position corresponding to said temperature detecting element.

6. A fixing device comprising:

an elongated heat generating member extending in a longitudinal direction, and having a first region, and a second region provided in a position that is different from a position of the first region in the longitudinal direction;

an endless belt rotatable in contact with said heat generating member;

an opposing member opposing said endless belt, and being configured to form a nip in cooperation with said endless belt so that a recording material, on which a toner image is formed, is nipped and fed in the nip;

a heat conductive member extending in the longitudinal direction within the first region, in which a surface of said heat conductive member contacts said heat generating member;

a positioning portion provided at an end portion of said heat conductive member with respect to the longitudinal direction, so as to extend in a direction in which said positioning portion is spaced apart from said heat generating member;

a supporting member provided with a positioning portion opening at a position corresponding to the second region, and being configured to support said heat generating member via said heat conductive member;

an electrical power shut-off member located in said positioning portion opening of said supporting member, and being configured to shut off electrical power supplied to said heat generating member; and a spacer member provided in the second region of said heat generating member, and in contact with said heat generating member, said electrical power shut-off member being contacted to said spacer member, wherein said positioning portion is configured to be inserted into said positioning portion opening of said supporting member to prevent movement of said heat conductive member.

7. The fixing device according to claim 6, wherein said spacer member is formed of a resin material.

8. The fixing device according to claim 6, wherein said heat conductive member is formed of a metal material.

9. The fixing device according to claim 6, wherein said positioning portion is a part of said heat conductive member.

10. The fixing device according to claim 6, further comprising a temperature detecting element provided in contact with said heat generating member via said heat conductive member in a third region of said heat generating member, the third region being provided in a position different from that of the first region and the second region with respect to the longitudinal direction, and said temperature detecting element being configured to detect a temperature of said heat generating member.

11. The fixing device according to claim 10, wherein said supporting member is provided with a temperature detecting element opening at a position corresponding to said temperature detecting element.

* * * * *